US005486839A

United States Patent [19]

Rodeffer et al.

[11] Patent Number: 5,486,839

[45] Date of Patent: Jan. 23, 1996

[54] CONICAL CORRUGATED MICROWAVE FEED HORN

[75] Inventors: Charles E. Rodeffer, Burlington, Iowa; Edgar J. Denlinger, Princeton Junction, N.J.; Aly E. Fathy, Langhorne, Pa.

[73] Assignee: Winegard Company, Burlington, Iowa

[21] Appl. No.: 282,787

[22] Filed: Jul. 29, 1994

[51] Int. Cl.[6] ..... H01Q 13/00

[52] U.S. Cl. ..... 343/786; 343/772

[58] Field of Search ..... 343/786, 762, 343/772

[56] References Cited

U.S. PATENT DOCUMENTS

| | | | |
|---|---|---|---|
| 4,040,061 | 8/1977 | Roberts et al. | 343/786 |
| 4,358,770 | 11/1982 | Satoh et al. | 343/786 |
| 4,408,208 | 10/1983 | Dumas | 343/786 |
| 4,554,553 | 11/1985 | Grim | 343/786 |
| 4,658,258 | 4/1987 | Wilson | 343/786 |
| 4,797,681 | 1/1989 | Kaplan et al. | 343/786 |
| 4,847,574 | 7/1989 | Gauthier et al. | 33/21 A |
| 4,903,037 | 2/1990 | Mitchell et al. | 343/762 |
| 4,910,527 | 3/1990 | Dushane et al. | 343/786 |
| 5,126,750 | 6/1992 | Wang et al. | 343/786 |

FOREIGN PATENT DOCUMENTS

| | | |
|---|---|---|
| 0079533 | 11/1982 | European Pat. Off. . |
| 1008954 | 5/1952 | France . |
| 3146273 | 5/1983 | Germany . |
| 1219872 | 1/1971 | Italy . |

OTHER PUBLICATIONS

"Corrugated horns for microwave antennas," Carricoats and Olver, 1984.

*Primary Examiner*—Donald T. Hajec
*Assistant Examiner*—Tho Phan
*Attorney, Agent, or Firm*—Dorr, Carson, Sloan & Birney

[57] ABSTRACT

A conical corrugated microwave feed horn. A conical flare section is formed at the aperture of the feed horn and a second smooth cylindrical section is formed at the throat of the feed horn. The conical flare section is formed with two regions. The first region is a corrugated conical region formed at the aperture and having a plurality of slots formed parallel to the central axis of the feed horn. Each slot in the plurality of slots has an inner surface closest to the central axis of the feed horn and an outer surface furthest from the central axis. Connecting the corrugated conical region to the cylindrical throat is a smooth conical region. The first slot adjacent the smooth conical region has first and second formed lips on the terminating end thereof. The lips are formed directed inwardly toward each other. The last slot of the plurality of slots at the aperture of the feed horn has the terminating end of the inner surface extending in length beyond the length of the outer surface,

16 Claims, 5 Drawing Sheets

CONICAL CORRUGATED MICROWAVE FEED HORN

BACKGROUND OF THE INVENTION

1. Field of the Invention

This invention relates to microwave antennas and, more particularly, to a low cost conical corrugated feed horn for use in an offset parabolic microwave antenna.

2. Statement of the Problem

A need exists for low-cost microwave feed horns for use in offset satellite dish antennas that are small in size and low in cost. Yet, the feed horn should exhibit superior reception characteristics. The feed horn also should provide higher gain and narrower beamwidth especially when used with small offset parabolic dishes (e.g., 18-inch-diameter dishes) where interference from neighboring satellites and signal levels are of primary concern. The feed horn should also provide lower sidelobe levels that reduce reflection effects from ground objects and that also reduce interference from neighboring satellites. The feed horn should also exhibit greater bandwidth so that it can be used for both the Fixed Satellite Service (FSS) and Broadcast Satellite Service (BSS) satellite bands. The feed horn should also provide nearly equal E & H plane patterns. Finally, the feed horn should provide an axial ratio for circular polarization of less than 1 dB.

Results of Prior Art Search

The following patents were uncovered in a prior art search on conical corrugated feed horns.

The 1987 patent to Wilson (U.S. Pat. No. 4,658,258) provides a low-cost tapered feed horn with substantially identical E & H plane patterns. The Wilson feed horn utilizes a tapered wave translation surface having one or more annular channels that are parallel to the central axis of the feed horn. Each annular channel extends concentric and parallel to the axis of symmetry with the side walls of the annular channels being of unequal length and parallel to each other. The side walls overlap each other from the terminating short of the annular channel a distance of one-quarter wave length of the microwave frequency of operation.

The 1982 European patent application number 0079533 pertains to an approach similar to that of Wilson in that the grooves are cut parallel to the radiator axis. However, this application contemplates providing a specially curved funnel contour or profile to the wave translation surface.

The 1983 German patent DE 3,146,273 A1 also sets forth a grooved feed horn radiator having the grooves formed parallel to the axis of the feed horn. The grooves in this patent substantially overlap and the design is similar to the above European patent application.

The remaining patents also show corrugated feed horn designs that are not as close as those discussed above. The French Patent No. 1,008,954 sets forth stacked corrugations in a rectangular feed horn. Italian Patent No. 1,219,872 provides a flat horn radiator. U.S. Pat. No. 4,408,208 pertains to a corrugated feed horn using a plurality of laminations that are dip-braze bonded. The corrugations are perpendicular to the central axis of the feed horn. U.S. Pat. No. 4,358,770 also sets forth a feed horn having corrugations perpendicular to the central axis of the feed horn. U.S. Pat. No. 4,847,574 sets forth a multi-band feed system capable of operating simultaneously with a plurality of separate wide bandwidths. U.S. Pat. No. 5,126,750 sets forth corrugated slots for providing mode conversion between a first flared region of magnetic coating and a second flared region.

The topic of corrugated horns for microwave antennas is thoroughly discussed in the book "Corrugated Horns for Microwave Antennas" by Clarricoats and Olver, IEE Electromagnetic Waves Series 18, Peter Peregrinus Ltd. (1984).

Solution to the Problem

The present invention provides a solution to the above problem with a unique conical corrugated feed horn design having a first flare section that is smooth and a second flare section with conical corrugated walls. A plurality of slots are formed parallel to the central axis of the feed horn in the corrugated walls of the second section. The throat of the feed horn is cylindrical and is connected to the smooth conical region of the first section. The first slot in the corrugated walls of the second section has formed lips on the terminating ends of the inward and outward surfaces of the first slot wherein the formed lips are directed inwardly toward each other. The last slot of the plurality of slots at the aperture of the feed horn is designed so that the length of the outer slot surface is shorter than the length of the inner slot surface. The combination of the two inwardly formed lips on the first slot and the shorter length of the outer surface wall of the last slot contribute to achieving near-perfect E & H plane patterns with an axial ratio well less than 1 dB. Furthermore, the feed horn of the present invention provides higher gain and narrower beamwidth, making it ideal for use with smaller parabolic dishes. The feed horn of the present invention also exhibits lower sidelobe levels to reduce reflection effects from ground objects and interference from neighboring satellites. Finally, the feed horn of the present invention exhibits greater bandwidth so that it can be used for both the FSS and BSS satellite bands.

SUMMARY OF THE INVENTION

A conical corrugated microwave feed horn provides two sections. A conical flare section is formed at the cylindrical aperture of the feed horn and a smooth cylindrical section is formed at the cylindrical throat. The conical flare section is formed with two regions. A corrugated conical region formed at the aperture and has a plurality of slots formed parallel to the central axis of the feed horn. Each slot of the plurality of slots has an inward surface closest to the central axis of the feed horn and an outer outward surface furthest from the central axis. Connecting the corrugated conical region to the cylindrical throat section is a smooth conical region. The first slot of the plurality of slots is adjacent the smooth conical region and has first and second formed lips on the terminating ends thereof. The lips are formed directed inwardly toward each other over the slot opening. The last slot of the plurality of slots at the aperture of the feed horn has the terminating end of the inward surface extending in length beyond the length of the outward surface.

DETAILED SPECIFICATION

Overview

Figure 1:
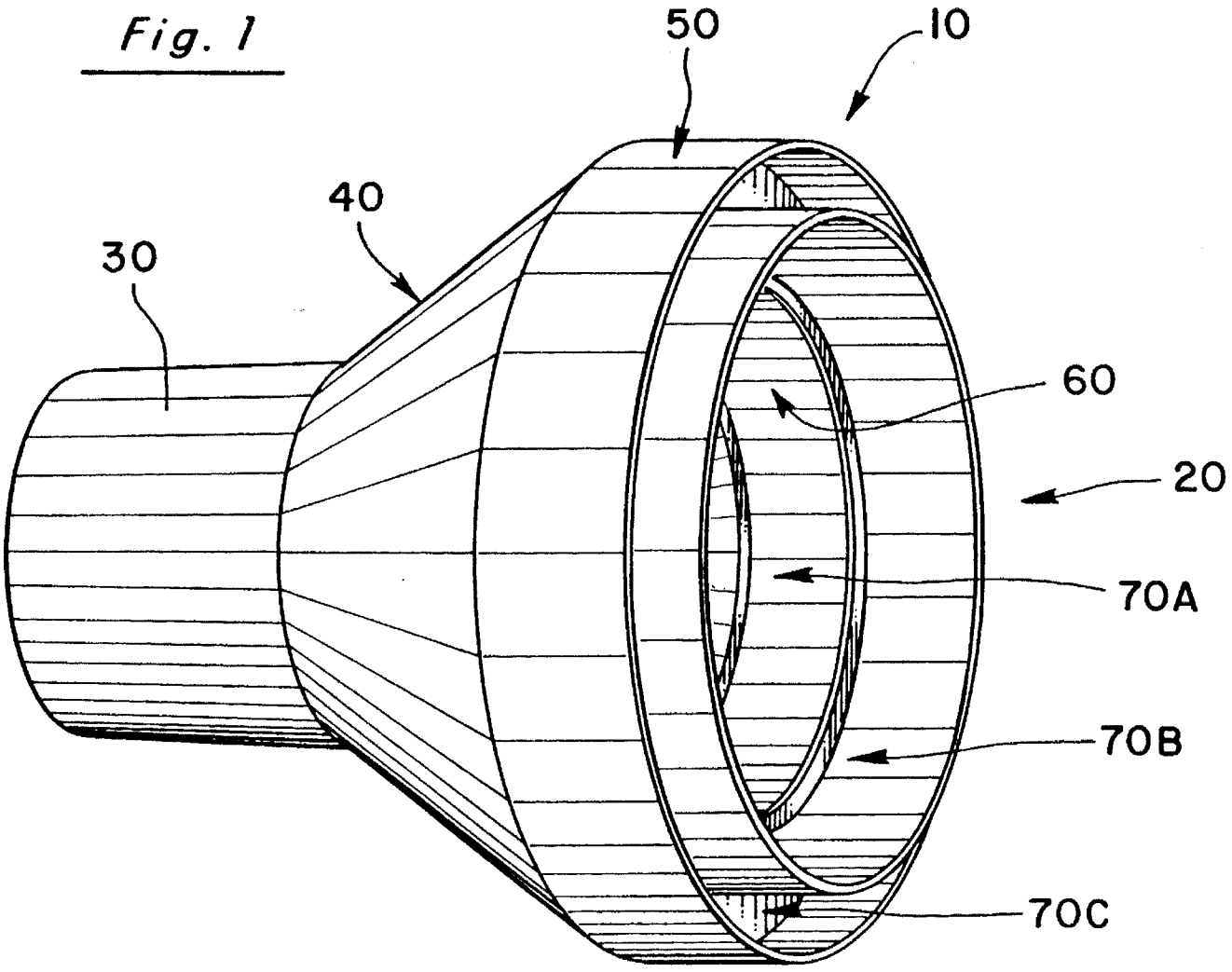
FIG. 1 is a perspective view of the conical corrugated microwave feed horn of the present invention.

In FIG. 1 the conical corrugated microwave feed horn 10 of the present invention is illustrated. The feed horn 10 has an aperture 20 and a cylindrical throat 30. The feed horn 10 has on the exterior a conical section 40 and a cylindrical portion 50. Inside the feed horn 10 is a conical flared section 60. Also shown in FIG. 1 are a plurality of slots 70 in a corrugated region of the flare section 60.

In the preferred embodiment, the feed horn 10 is manufactured from metal such as aluminum or an aluminum alloy. The feed horn 10 can be manufactured either as a die-cast and rollover construction or it can be manufactured in two separate pieces and then affixed together.

Description

Figure 3:
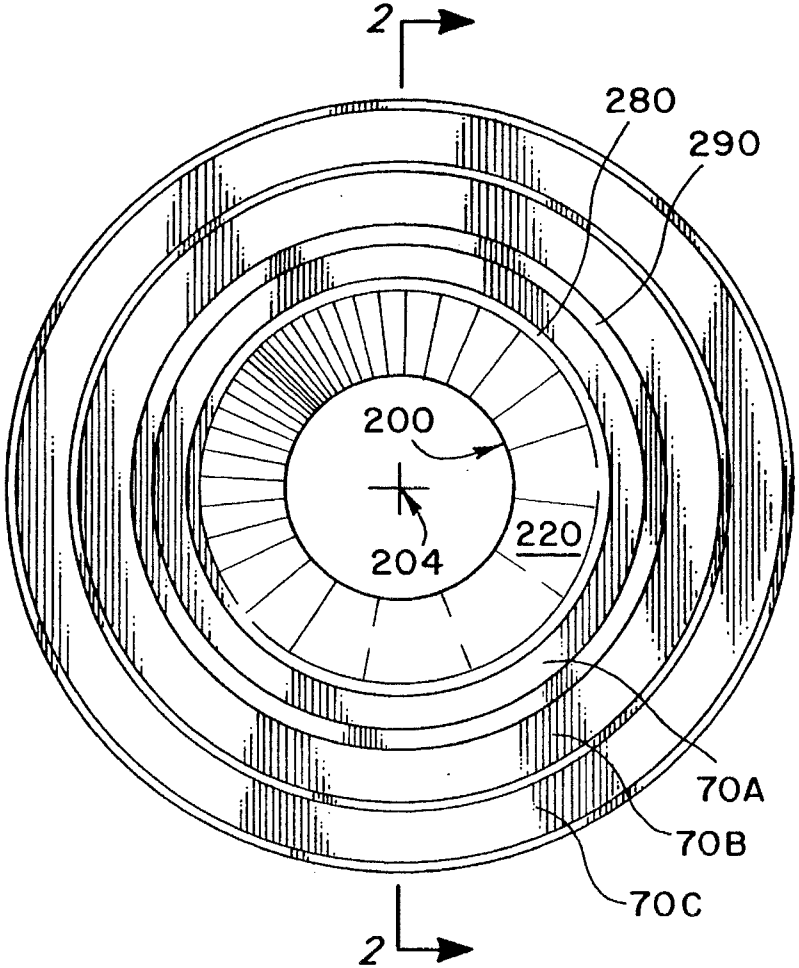
FIG. 3 is a front planar view of the feed horn of FIG. 1.
Figure 2:
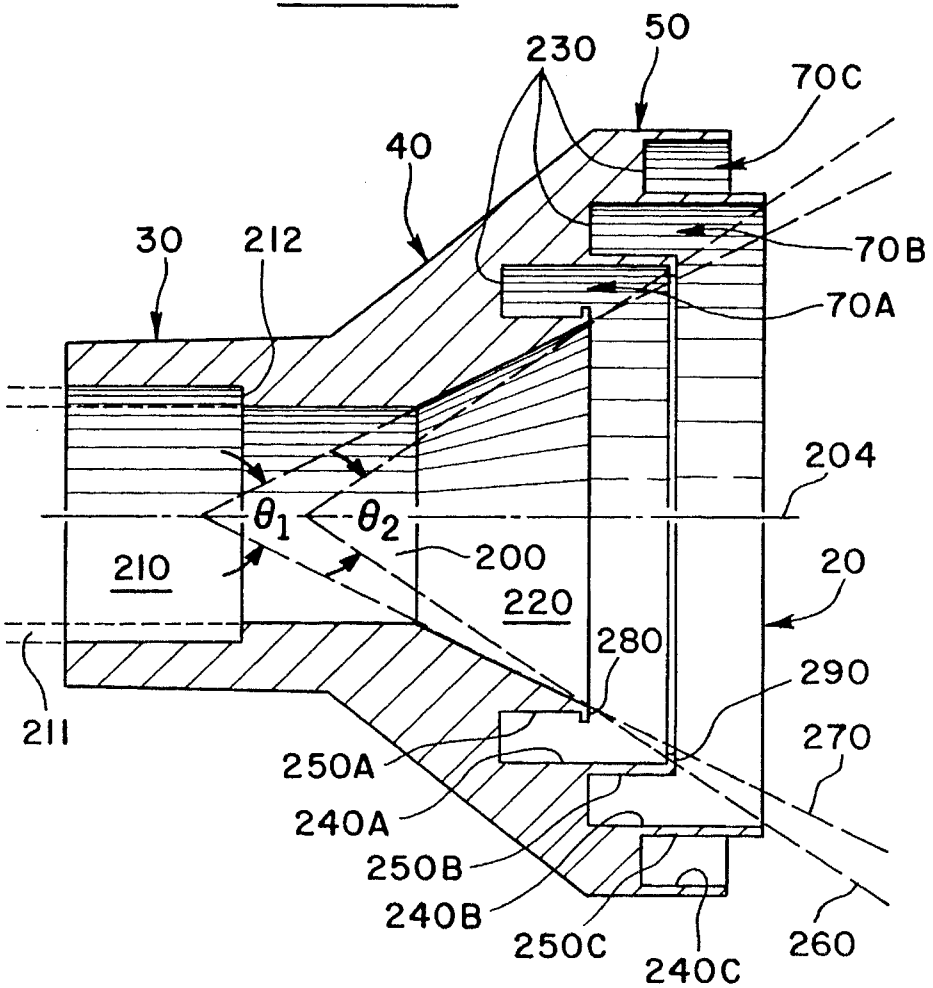
FIG. 2 is a cross-sectional view of the feed horn of FIG. 1.

In FIGS. 2 and 3, details of the structure of the feed horn 10 of the present invention are illustrated.

On the interior of the feed horn 10 and in the throat section 30 is a first cylindrical throat region 200 that couples to a second cylindrical throat region 210. The second cylindrical throat region 210 has a greater diameter than the first throat region 200. Step 212 separates the two regions. In the preferred embodiment, step 212 is 0.125 inch and functions to mate the feed horn 10 to a circular waveguide, shown in dotted lines as 211 in FIG. 2, having an inner diameter of 0.62 inch and an outer diameter of 0.75 inch. When circular wave guide 211 is installed, no step 212 exists. The feed horn 10 of the present invention actually ends at step 212.

a. Providing Wider Bandwidth

The first cylindrical throat region 200 also couples to a smooth conical surface or intermediate smooth conical region 220. This region 220 forms a first angle, $\theta_1$ with the central axis 204 of the feed horn 10. Region 220 provides an impedance match between the tapered slots 70 and the circular wave guide 200. The smooth taper transition of region 220 provides wider bandwidth than designs having step transitions so that the feed horn of the present invention can be used with the FSS or BSS satellite bands.

This smooth conical region 220 also forms the first region of the flare section 60 of the feed horn 10. The second region of the flare section 60 includes the slots 70A, 70B, and 70C, and this region is corrugated because of the slots. Each slot 70 is parallel to the central axis 204 of the feed horn. Each slot 70 has a rectangular terminating end 230 (perpendicular to axis 204), and in the preferred embodiment each slot at end 230 is identical. Each slot 70 has an outer surface 240 and an inner surface 250. All surfaces 240 and 250 in the preferred embodiment are essentially parallel to each other and to the central axis 204, although a slight taper exists toward the opening of the slots 70 for mold release.

The outer ends of the inner surfaces 250 each lie on a conical region 260 that forms an angle $\theta_2$ with the central axis 204. Under the teachings of the present invention, the angle $\theta_2$ is greater than the angle $\theta_1$, which in the preferred embodiment is 49.4°. In the preferred embodiment, $\theta_2$ equals 71.5°. These angles and the following dimensions are for a feed horn of the present invention designed to operate with a center frequency of 12.45 GHz. It is to be expressly understood that under the teachings contained herein that the feed horn could be designed to function at other suitable center frequencies. The provisions of the smooth conical region 220 provides an impedance match between the impedance of the throat and the corrugated region so as to achieve greater bandwidth.

b. Narrowing Beamwidth and Increasing Gain

The first slot 70A has a pair of formed lips 280 and 290 on the terminating ends thereof. The first slot 70A has a depth of about one-half wavelength (0.50 inch) from the outer surface 240A and a depth of about one-quarter wavelength (0.25 inch) from the inner surface 250A of the center frequency 12.45 GHz. The second slot 70B has the same dimensions. The third slot has a depth between one-quarter and one-half wavelength (0.35 inch) from the inner surface 250C and a depth of one-quarter wavelength (0.25 inch) from the outer surface 240C.

The first lip 280 is radially directed outward from the terminating end so as to lie on a plane perpendicular to the central axis 204. The second lip 290 is radially directed inward toward the central axis 204, also in a plane orthogonal thereto. Lip 280 is formed on the terminating end of inner surface 250A, and lip 290 is formed on the terminating end of the outer surface 240A.

The inwardly directed lips 280 and 290 narrow the beam width by about one degree at −20 dB relative to the main peak and increase the feed horn gain by about 0.3 dB. In the preferred design the lips are directed in at a dimension less than 1/20 wavelength (i.e., 0.05 inch). A good axial ratio of about 0.5 dB is also achieved. Slot 70A has the dominant effect over the other slots 70B and 70C, and by optimizing slot 70A as discussed above, the pattern symmetry improves, with a reduction in phase variation across the aperture. It is to be understood that other suitable designs could be used in lieu of lips 280 and 290 that function in an equivalent fashion. For example, different materials could be used to achieve the same effect although this would result in a higher manufacturing cost.

c. Reducing Sidelobes

In the preferred embodiment, slots 70A and 70B have their outer surfaces 240 longer in length than the length of their corresponding inner surfaces 250. The last slot 70C, however, has its outer surface 240C shorter in length than the length of its inner surface 250C.

Slots 70B and 70C, while having minor effects on the cross-polarization level and pattern beamwidth, help shape the sidelobe levels. The outer corrugated ring 70C has its outer surface 240C shorter in order to further reduce the sidelobe levels of the antenna pattern when incorporated with an offset dish antenna.

It is to be understood that the above discussed structural features of the feed horn of the present invention could be selectively used in a number of combinations. For example, slot 70C could be configured as slot 70B and the feed horn would still have the smooth conical region 220 and the lips 280 and 290.

Preferred Design

Figure 4:
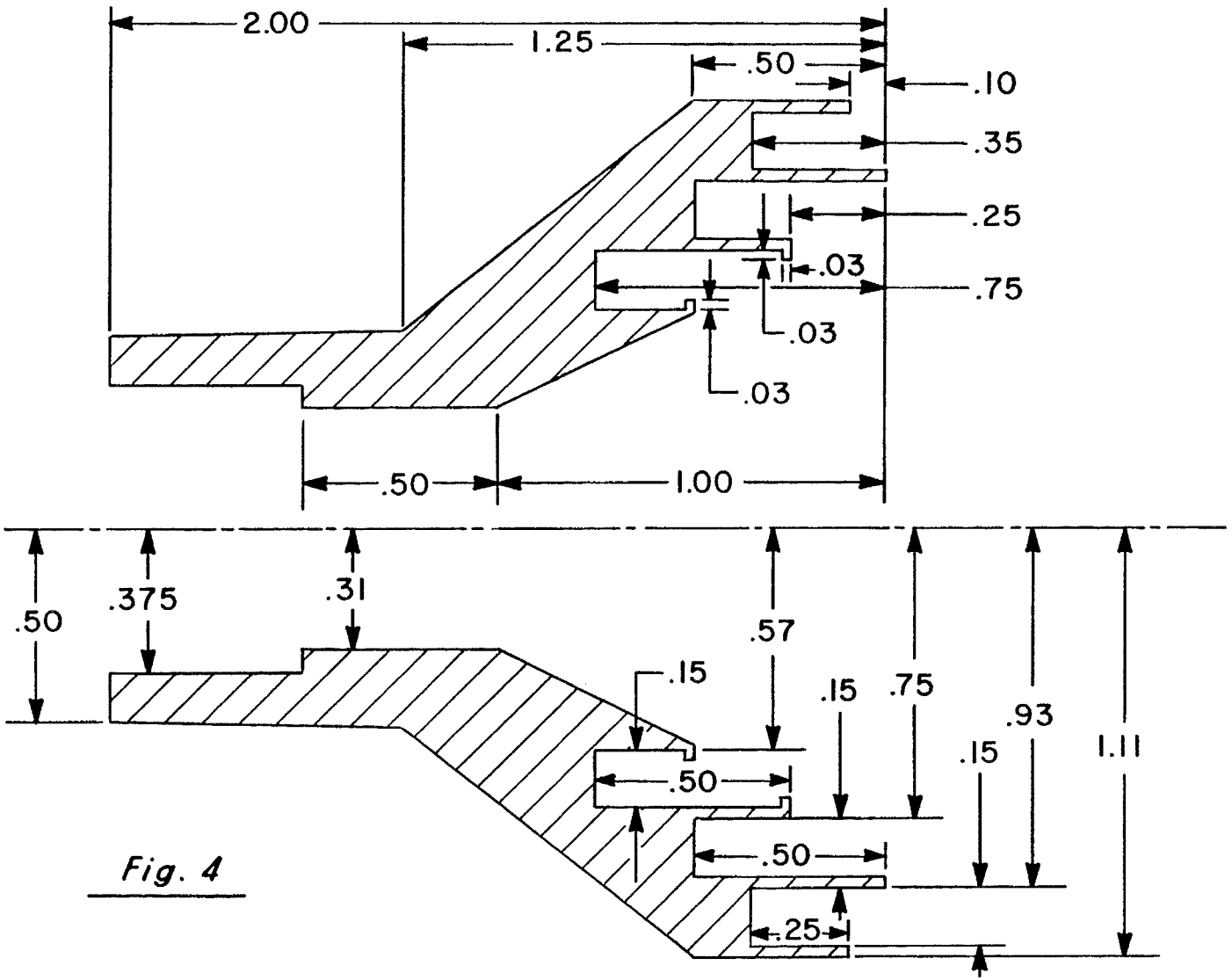
FIG. 4 sets forth the cross-sectional view of FIG. 2 with dimensions shown in inches for the preferred embodiment of the feed horn of the present invention.

The feed horn 10 of the present invention is designed, as mentioned in the preferred embodiment, for use in the microwave frequency range of 12.2 to 12.7 GHz. FIG. 4 sets forth the dimensions for the preferred design of the present invention for 12.45 GHz, which is the center frequency of this range. The dimensions of FIG. 4 are shown in inches.

The feed horn 10 of the present invention was conventionally tested. A source antenna driven by a Hewlett-Packard HP8350 Signal Generator was located 125 meters from the feed horn 10 under test. The feed horn 10 under test was selectively rotated by a Polarity Positioner and moved in the azimuth direction by an Azimuth Positioner, both positioners being motor driven. A Hewlett-Packard HP8566 Spectrum Analyzer was interconnected to the feed horn 10 of the present invention to receive the transmitted signals from the source antenna.

Figure 5:
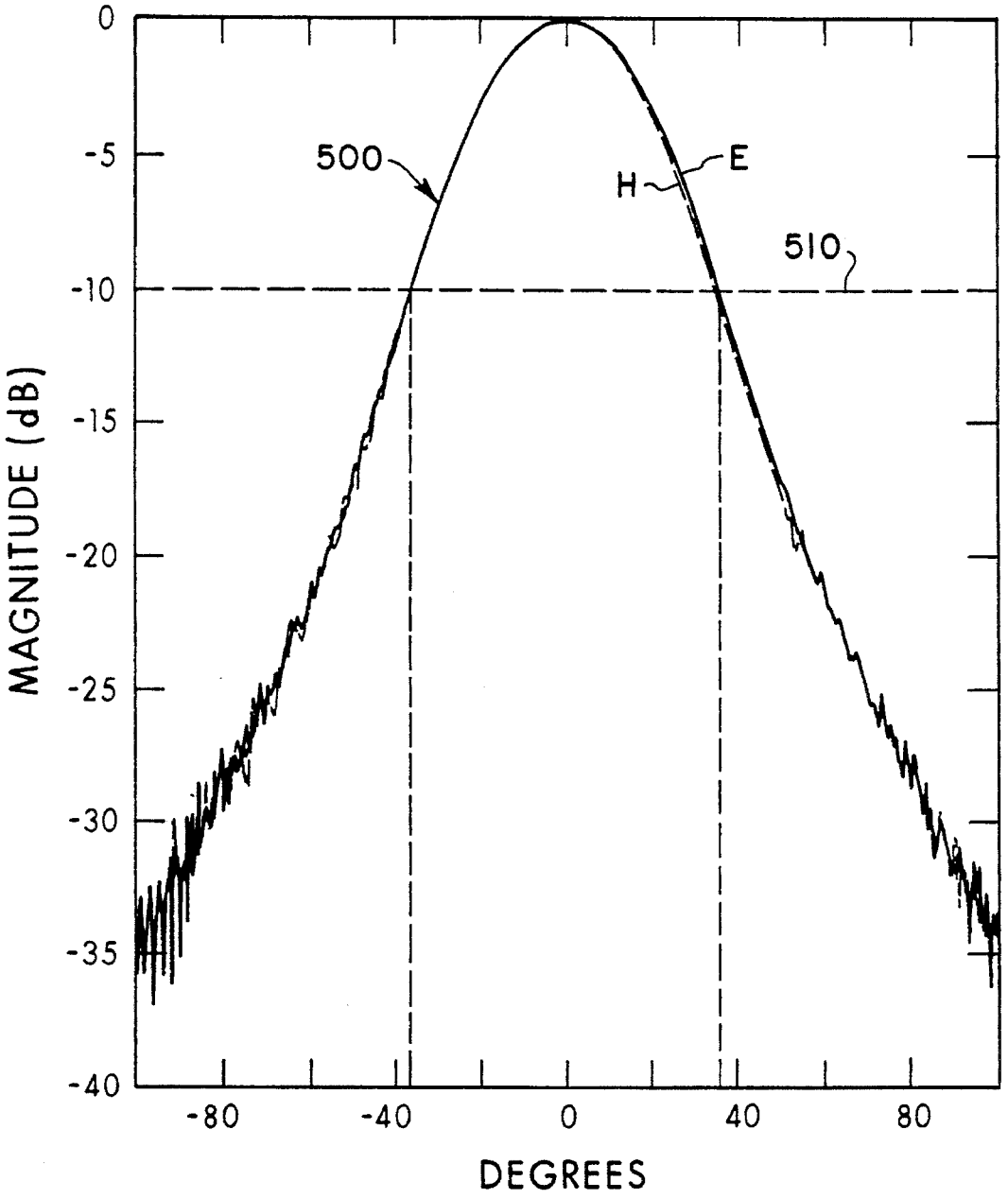
FIG. 5 sets forth the H and E curves for the feed horn of FIG. 4.
Figure 6:
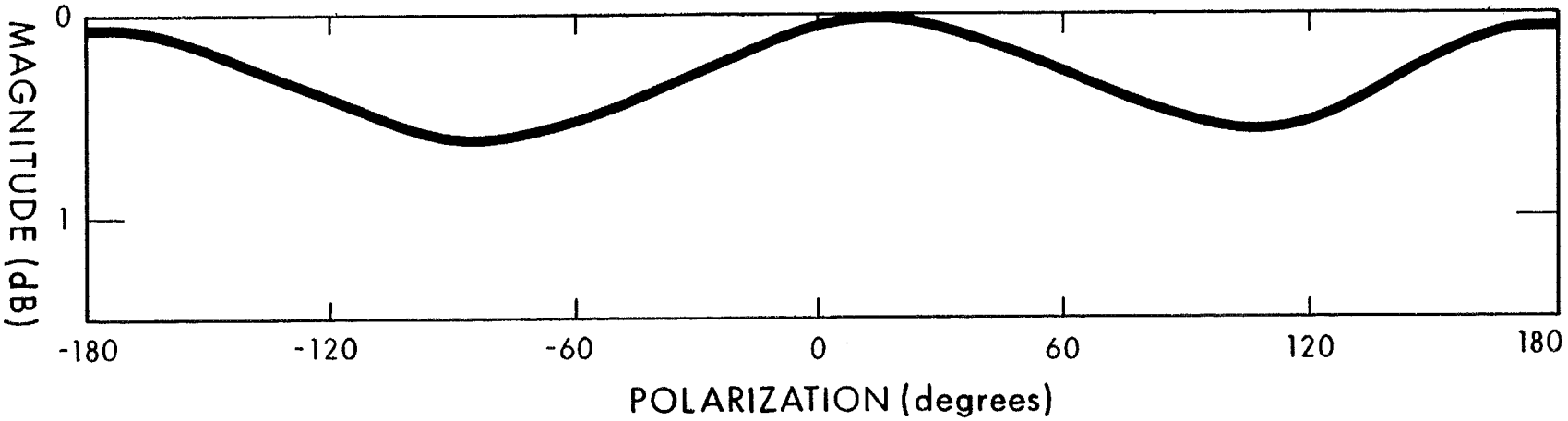
FIG. 6 sets forth the polarization of the feed horn of FIG. 4.

In FIGS. 5 and 6 are shown the results of testing the feed horn 10 of the present invention based on the design of FIG. 4. In FIG. 5, plots 500 of the E & H patterns are shown to substantially coincide. The curve 500 is essentially the same curve for both the E & H planes. The vertical scale is the magnitude in dB of the signal. At 0°, the curve 500 is normalized to 0 dB. In application, an antenna, not shown, would be designed to have its edges have a 10 dB loss as represented by dotted line 51 0. The antenna therefore would have its edges at about ±40°. Hence, the curve 500 between 0 dB and the −10 dB line 510 is for all practical purposes identical for both the E & H planes.

In FIG. 6, the axial ratio for circular polarization is shown. In this test, the feed horn 10 of the present invention as set forth in FIG. 4 was rotated at the boresight of 0°. The variation through 360° of rotation is less than 1 dB.

Although specific applications, materials, components, connections, sequences of events, and methods have been stated in the above description of the preferred embodiment of the invention, other suitable materials, applications, components, and process steps as listed herein may be used with satisfactory results and various degrees of quality. In addition, it will be understood that various other changes in details, materials, steps, arrangement of parts, and uses that have been herein described and illustrated to explain the nature of the invention will occur to and may be made by those skilled in the art, upon a reading of this disclosure, and such changes are intended to be included within the principles and scope of this invention as hereinafter claimed.

We claim:

1. A conical corrugated microwave feed horn comprising in combination:

a conical flare section, said flare section having a smooth conical region and a corrugated conical region, said feed horn having a cylindrical aperture formed on a first open end, a cylindrical throat formed on a second open end opposing said cylindrical aperture, a plurality of slots formed parallel to the central axis of said feed horn in said corrugated conical section, each slot of said plurality of slots having an inner surface with an outer end closest to the central axis of said feed horn and an outer surface furthest from the central axis, said plurality of slots having a first slot connected to said smooth conical region, said smooth conical region connecting said cylindrical throat to said outer end of said first slot of said plurality of slots, said smooth conical region having a first predetermined angle from the central axis of said feed horn through said first slot connection, said smooth conical region providing an impedance match between said corrugated conical region and said cylindrical throat so as to increase the bandwidth of said feed horn, each slot of said plurality of slots having the outer end of the inner surface formed on a conical shape having a second predetermined angle from the central axis through said first slot connection, said second predetermined angle being greater in value than said first predetermined angle.

2. The feed horn of claim 1 wherein said first predetermined angle is 49.4 degrees.

3. The feed horn of claim 1 wherein said second predetermined angle is 71.5 degrees.

4. A conical corrugated microwave feed horn comprising in combination:

a conical flare section, said flare section having a corrugated conical region, said feed horn having a cylindrical aperture formed on a first end, a cylindrical throat formed on the end of said feed horn opposing said cylindrical aperture, a plurality of slots formed parallel to the central axis of said feed horn in said corrugated conical region, each slot of said plurality of slots having an inner surface with an outer end closest to the central axis of said feed horn and an outer surface furthest from the central axis, the first slot of said plurality of slots located nearest said cylindrical throat, at least one lip on said first slot providing (1) a narrower beamwidth for said feed horn and (2) an increase in feed horn gain.

5. A conical corrugated microwave feed horn comprising in combination:

a conical flare section, said flare section having a corrugated conical region, said feed horn having a cylindrical aperture formed on a first end, a cylindrical throat formed on the end of said feed horn opposing said cylindrical aperture, a plurality of slots formed parallel to the central axis of said feed horn in said corrugated conical region, each slot of said plurality of slots having an inner surface with an outer end closest to the central axis of said feed horn and an outer surface furthest from the central axis, the first slot of said plurality of slots located nearest said cylindrical throat, means on said first slot for providing (1) a narrower beamwidth for said feed horn and (2) an increase in feed horn gain, said means on said first slot for providing comprising: first and second formed lips on the outer ends of said first slot, said first formed lip formed on the outer end of said inner surface of said first slot and directed radially outward from the central axis toward said outer surface of said first slot, said first slot further having said second formed lip on the terminating end of said outer surface and directed radially inward toward the central axis.

6. The feed horn of claim 5 wherein each of said first and second formed lips extends about 1/20th of the center frequency wavelength of said feed horn into said first slot.

7. A conical corrugated microwave feed horn comprising in combination:

a conical flare section, said flare section having a corrugated conical region, said feed horn having a cylindrical aperture formed on a first end, a cylindrical throat formed on the end of said feed horn opposing said cylindrical aperture, a plurality of slots formed parallel to the central axis of the feed horn in said corrugated conical region, each slot of said plurality of slots having an inner surface closest to the central axis of said feed horn and an outer surface furthest from the central axis, the last slot of said plurality of slots located nearest said cylindrical aperture having the length of the said inner surface extending in distance beyond the length of said outer surface for providing a reduction in the sidelobe levels so as to reduce reflection effects and interferences, each slot of said plurality of slots between said smooth conical region and said last slot having the length of said outer surface extend in distance beyond the length of said inner surface.

8. The feed horn of claim 7 wherein said inner surface of said last slot extends a distance less than one-half the wavelength of the center frequency of said feed horn.

9. The feed horn of claim 7 wherein said outer surface of said last slot extends a distance less than one-quarter the wavelength of the center frequency of said feed horn.

10. A conical corrugated microwave feed horn comprising in combination:

a conical flare section, said flare section having a smooth conical region and a corrugated conical region, said feed horn having a cylindrical aperture formed on a first end, a cylindrical throat formed on the end of said feed horn opposing said cylindrical aperture, a plurality of slots formed parallel to the central axis of said feed horn in said corrugated conical region, each slot of said plurality of slots having an inner surface with an outer end closest to the central axis of said feed horn and an outer surface furthest from the central axis, said smooth conical region connecting said cylindrical throat to said outer end of the first slot of said plurality of slots, said smooth conical region providing a wider bandwidth for said feed horn, said first slot of said plurality of slots having first and second formed lips on the terminating ends of said first slot, said first formed lip formed on the terminating end of said inner surface of said first slot and directed radially outward from the central axis toward said outer surface of said first slot, said first slot further having said second formed lip on the terminating end of said outer surface and directed radially inward toward the central axis, said first and second lips providing a narrower beamwidth for said feed horn and an increase in feed horn gain, the last slot of said plurality of slots having the terminating end of said inner surface extend in length beyond the length of said outer surface for providing a reduction in the sidelobe levels so as to reduce reflection effects and interferences, and each slot of said plurality of slots between said smooth conical region and said last slot having the length of said outer surface extend in distance beyond the length of said inner surface for reducing sidelobe interference.

11. The feed horn of claim 10 wherein said smooth conical region is formed at an angle of 49.4 degrees from the central axis.

12. The feed horn of claim 10 wherein said corrugated region is formed at an angle of 71.5 degrees from the central axis.

13. The feed horn of claim 10 wherein each of said first and second formed lips extends about 1/20th of the center frequency wavelength of said feed horn into said first slot.

14. The feed horn of claim 10 wherein said inner surface of said last slot extends a distance less than one-half the wavelength of the center frequency of said feed horn.

15. The feed horn of claim 10 wherein said outer surface of said last slot extends a distance less than one-quarter the wavelength of the center frequency of said feed horn.

16. A conical corrugated microwave feed horn for use in the frequency range of 12.2 to 12.7 GHz comprising in combination:

a conical flare section, said flare section having a smooth conical region and a corrugated conical region, said feed horn having a cylindrical aperture formed on a first end, a cylindrical throat formed on the end of the feed horn opposing said cylindrical aperture, three slots formed parallel to the central axis of said feed horn in said corrugated conical region, each slot of said three slots having an inner surface closest to the central axis of said feed horn and an outer surface furthest from the central axis, said smooth conical region connecting said cylindrical throat to said first slot of said three slots, said first slot of said three slots having first and second formed lips formed at the opening of said first slot, said first formed lip directed radially outward from the central axis, said second formed lip directed radially inward toward the central axis, the third slot of said three slots having the length of said inner surface extend in distance beyond the length of said outer surface, the second slot between said first and third slots having the length of said outer surface extend in distance beyond the length of the inner surface.

* * * * *